United States Patent [19]

Pellerin

[11] Patent Number: 5,054,789

[45] Date of Patent: Oct. 8, 1991

[54] METHOD AND APPARATUS FOR THE PLAY OF A MATCHING GAME

[76] Inventor: Curtis L. Pellerin, 4400 E. Owens Ave. #80, Las Vegas, Nev. 89110

[21] Appl. No.: 606,125

[22] Filed: Oct. 31, 1990

[51] Int. Cl.[5] ..... A63F 9/00

[52] U.S. Cl. ..... 273/288

[58] Field of Search ..... 273/1 R, 281, 282, 282 A, 273/282 B, 282 C, 153 R, 288

[56] References Cited

U.S. PATENT DOCUMENTS

| | | | |
|---|---|---|---|
| 176,144 | 4/1876 | McDougall | 273/182 R |
| 1,432,062 | 10/1922 | Greene | 273/88 |
| 3,836,150 | 9/1974 | Forgraves | 273/182 R |
| 4,147,362 | 4/1979 | Fisher | 273/88 |
| 4,199,145 | 4/1980 | Gouraige, Jr. | 273/88 |
| 4,201,389 | 5/1980 | Vowell | 273/281 |
| 4,216,964 | 8/1980 | Gans | 273/282 A |
| 4,496,327 | 1/1985 | Bennett | 273/282 A |
| 4,776,597 | 10/1988 | Rudell | 273/282 A |

*Primary Examiner*—Theatrice Brown

*Attorney, Agent, or Firm*—Richard C. Litman

[57] ABSTRACT

A matching board game allows younger pre-literate or illiterate players to successfully play and score the game, while also providing an enjoyable method of learning the alphabet and basic number system. The game consists of a game board having thirty six spaces equal to the characters in the English alphabet and the numbers one through ten, corresponding matching blocks, and matching playing tiles. The game is played by drawing a tile and matching the alphanumeric character on the tile to the character on a block and withdrawing that block from its space on the board. The player with the highest stack of blocks when all blocks have been removed from the board is the winner. Alternatively, the rows of spaces of the board, corresponding blocks and tiles may be colored with the colors of the rainbow, permitting other variations in which the playing tiles and blocks may be matched according to color or the goal is to secure all the blocks of one color of at least one block of each color. Other versions allow blocks to be taken from the stacks of opponents if those blocks are not on the board, or the winner may be determined by the player having the highest stack of blocks at the end of a given time period.

19 Claims, 1 Drawing Sheet

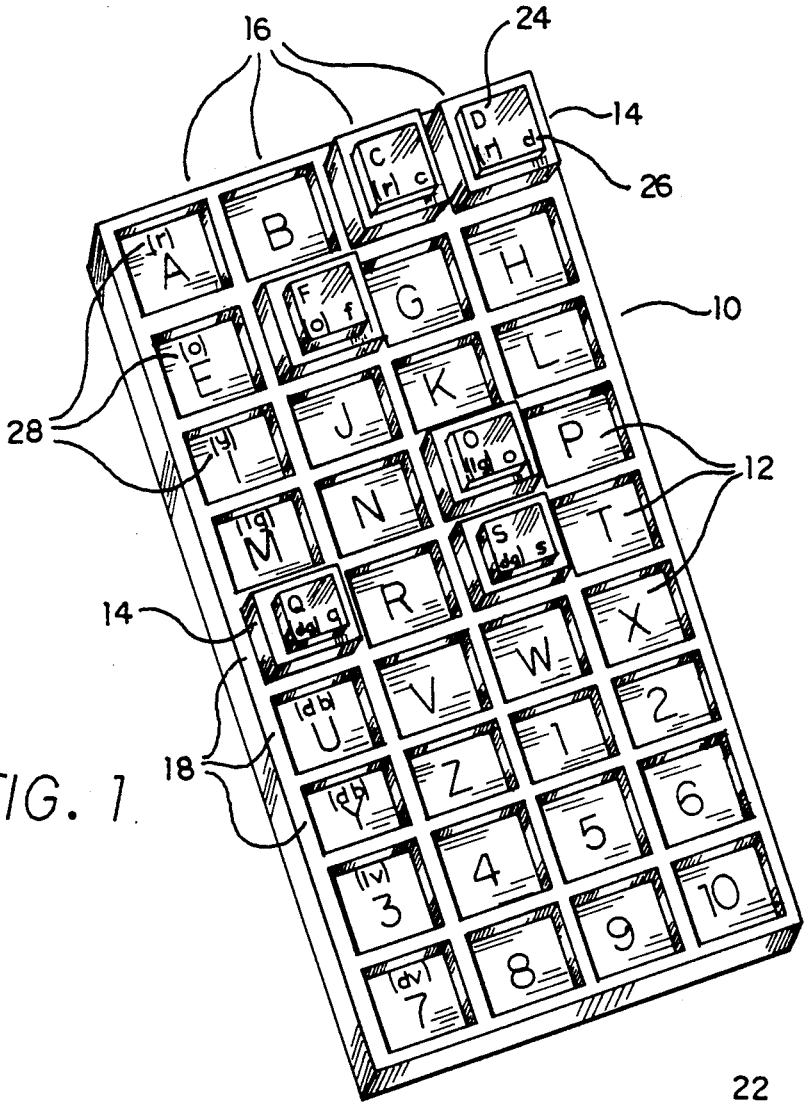
FIG. 1
FIG. 3
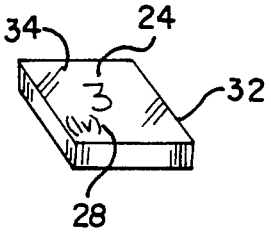
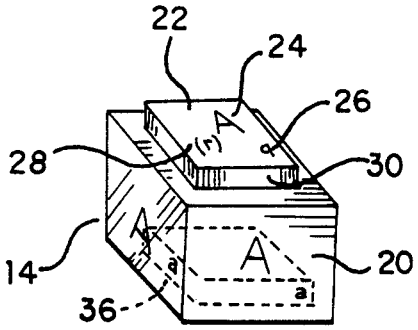
FIG. 2
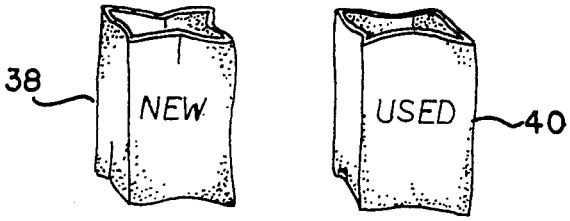
FIG. 4

METHOD AND APPARATUS FOR THE PLAY OF A MATCHING GAME

FIELD OF THE INVENTION

This invention relates generally to broad games, and more specifically to a board game apparatus comprising a compartmented game board, a plurality of stackable playing pieces and a plurality of playing tiles, and methods of play of that game.

BACKGROUND OF THE INVENTION

It is generally acknowledged that one of the more difficult early learning tasks is that of learning the English alphabet. At approximately the same time, children are expected to learn the basic Arabic numerals from one to ten and to begin to understand basic arithmetic. The traditional methods of teaching these skills have been shown to be tedious at best, and often lead to a dislike of learning activities by children.

One solution to the above problem is to incorporate the above learning tasks into a game, thus providing the instruction necessary and at the same time creating a competitive and enjoyable environment for the students. However, few games have been developed which teach such basic skills. Rather, most games which involve the use of the alphabet or numbers require at least a basic knowledge of those characters before the game can be played. In addition, those games that are known to the applicant which are capable of teaching basic alphanumeric skills require the player to have already developed some skill in the tasks involved in the play of the game in order to be successful. This can be discouraging to a less skillful or less knowledgeable player, thus often leading to other learning problems.

The need arises for a game which may be easily played by children who have not yet developed sophisticated alphanumeric skills, and yet in some variations is sufficiently advanced to hold the attention of older persons or adults. The game should test and enforce the learning of the alphanumeric system, as well as color variations. Moreover, it is desirable that the game also involve some use of motor skills for the players.

DESCRIPTION OF THE RELATED ART

Maris U.S. Pat. No. 943,435 discloses a board game containing a plurality of multicolored and numbered squares. The playing pieces are marked with different colors in a diagonal pattern. This game provides only for the matching of colors on adjacent playing pieces, thus creating geometric patterns, rather than the use or teaching of any alphabetic skills. The scoring of the game requires arithmetical skills beyond the scope of those required for the play of the game of the present invention. Moreover, no disclosure is made of a compartmented game board for the containment of playing pieces, nor of any provision for the physical stacking of the pieces.

Smith U.S. Pat. No. 3,413,004 discloses a game having a plurality of lettered and colored playing pieces which are used to form words and match with letters on a playing board. However, the play of the game is conducted by calling out a letter and color and matching that letter and/or color on the board, in a manner substantially different from that of the present invention. No provision is made for the stacking of playing pieces. Moreover, no basic numerical skills are taught in the play of the game; however, the scoring system is relatively complex.

Hincz U.S. Pat. No. 3,677,548 discloses a board game appartus containing a plurality of variously shaped geometric playing pieces. The game teaches no alphanumeric skills, but merely serves to test spatial and tactile memory.

Finally, Rudell U.S. Pat. No. 4,776,597 discloses a game board and playing pieces which provide for the stacking of the playing pieces one upon another and upon the board. However, the play and scoring of the game are dependent upon the stacking of the playing pieces in that the letter exposed on the top playing piece is used as information in the play of the game. The playing pieces are stacked during the play of the game, thus exposing or covering various letters. No numerical or color recognition skills are taught or required.

None of the above noted patents, either singly or in combination, are seen to disclose the specific construction and method of play disclosed by the present invention.

SUMMARY OF THE INVENTION

By the present invention, an improved board game which teaches basic alphanumeric skills is disclosed.

Accordingly, one of the objects of the present invention is to provide an improved game board which provides for the separate containment of the individual playing pieces placed thereupon.

Another of the objects of the present invention is to provide a board game with playing pieces or blocks which are shaped so as to allow for the easy stacking of the pieces or blocks atop one another.

Still another of the objects of the present invention is to provide a board game containing a total number of spaces corresponding to the number of letters in the English alphabet in addition to the numbers one through ten, or a total of thirty six spaces.

An additional object of the present invention is to provide a board game in which the various rows of playing spaces on the board, and corresponding lettered or numbered playing pieces or blocks, are marked with various colors.

A further object of the present invention is to provide a board game in which the scoring of the game may be accomplished without any numerical skills on the part of the scorer.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

FIG. 1 is a perspective view of the playing board of the present invention, showing the divisions for the containment of the playing blocks and some of the blocks contained therein.

FIG. 2 is a perspective view of a single playing block.

FIG. 3 is a perspective view of a playing tile.

FIG. 4 is a persepctive view of the storage containers for the storage of the playing tiles during the play of the game.

Similar reference characters designate corresponding parts throughout the several figures of the drawings.

DESCRIPTION OF THE PREFERRED EMBODIMENT

Referring now to the drawings, particularly FIG. 1 of the drawings, the present invention will be seen to relate to an improved board game in which the matching or various alphanumeric characters and/or colors is required. The game board 10 shown in FIG. 1 comprises a matrix of partitioned spaces 12 for the containment of a series of colored blocks 14 marked with alphanumeric characters, an example of which is shown in FIG. 2.

Board 10 is preferably divided into a series of four vertical columns 16 by nine horizontal rows 18, thus creating a total of thirty six rectangular spaces 12. This number is equal to the number of characters in the English alphabet plus numbers one through ten, and board 10 is marked accordingly, with the letters A through Z marked in each space 12 from the upper left space 12 and proceeding horizontally across each row 18 and then down to the leftmost space 12 of the next row 18. In this manner, the topmost six and one half rows 18 of spaces 12 within board 10 will be marked with the letters of the English alphabet. The remaining two and one half rows 18 are marked with the numbers one through ten, beginning in the next available space 12 following the last letter of the alphabet and proceeding in the same manner.

In addition, the rows 18 are differentiated by colors. The preferred color pattern is essentially that of the visible spectrum, as displayed by a rainbow or prism. The colors of the nine rows 18, starting from the uppermost row 18 and proceeding downward to the bottom row 18, are respectively red, orange, yellow, light green, dark green, light blue, dark blue, light violet and dark violet. In order to indicate these colors on the monochromatic drawings, corresponding indicators 28 are shown in the leftmost space 12 of each row 18, and also on the example block 14 shown in FIG. 2. Each indicator 28 is comprised of the first letter or letters of each word or words describing the appropriate color for that row and is inserted in parentheses. Thus, the sixth row 18 down from the top of the board 10 contains the indicator 28 (lb) for light blue. Two blocks 14 with the letters Q and S marked on them are shown installed in the fifth row 18 down from the top of the board 10 in FIG. 1, and are also marked with the color indicator 28 (dg) indicating the dark green color of those blocks, which corresponds with the color of that row 18 of board 10.

A corresponding number of thirty six blocks 14 of rectangular plan form, an example of which is shown in FIG. 2, are formed so as to fit within each of the spaces 12 of board 10. Each block 14 comprises four vertical faces 20 and an upper horizontal face 22; the bottom of the block is provided with an indentation 36 in order to permit the stacking of the blocks atop one another. Thus, each block will have five flat faces each of which is marked with an alphanumeric character 24, as shown in FIG. 2. In the case of the twenty six letters of the English alphabet, character 24 may be an upper case or capital letter and optionally the corresponding lower case 26 of the letter may be placed upon each of the flat faces 20 or 22 of block 14.

Each of the blocks 14 is colored in order to match the color of the row 18 of board 10 in which its corresponding alphanumeric character is located. As an example, the block 14 shown in FIG. 2 is marked with upper case and lower case letters A. This particular block 14 would be installed in the upper left space 12 of board 10, the corresponding row 18 of which is colored red. This is noted on the block 14 shown in FIG. 2 by the color indicator (r), 28. Such color indicators 28 are not necessarily marked on each block 14 or within each space 12 of board 10, but are shown in the drawings to indicate the proper color of the block 14 or row 18 of board 10.

The top face 22 of each block 14 is surrounded by a shoulder 30. Shoulder 30 enables each block 14 to be stacked upon one another by allowing the top face 22 to nest within the lower indentation 36 of other blocks 14. By providing a slight interference fit between the shoulder 30 of each block 14 and the corresponding indentations 36 of other blocks 14, the blocks 14 may be fit together in a manner that when stacked atop one another, a substantial stack of such vertically stacked blocks 14 may be lifted merely by lifting the top block 14 of the stack. Such a close fitting relationship between each of the blocks 14 will serve to aid in the development of motor skills in the players.

In addition to the above board 10 and thirty six blocks 14, a number of tiles 32 are involved with the play of the game, an example of which is shown in FIG. 3. There are three tiles 32 with each alphanumeric character of the blocks 14 marked thereupon, or a total of one hundred eight tiles 32. Each tile 32 is marked on at least the upper surface 24 with one of the alphanumeric characters 24 of block 14 or spaces 12 of board 10, e.g. the numeral "3" shown on the upper surface 34 of tile 32 in FIG. 3.

Each tile 32 is colored with exactly the same color as that of the space 12 of board 10 or of the block 14 which is marked with the same letter or number as each given tile 32. Thus, the example shown in FIG. 3 which is marked with the numeral "3", would correspond to the leftmost space 12 of the eighth row 18 down from the top of board 10. This row 18 is colored light violet and is marked with indicator 28 (lv) in FIG. 1. The tile 32 shown in FIG. 3 displays a like indicator 28. These color differences may further serve to differentiate between similar letters or numbers, such as "N" and "Z" or "6" and "9" when viewed from different angles.

Tiles 32 stored in one of two containers 38 or 40, as shown in FIG. 4. Before the game begins, all tiles 32 are considered to be "new" as they have not yet been used in the course of play of that particular game, and thus are placed in the "new" container 38. Containers 38 and/or 40 are shown in the form of foldable sack like containers, but may take any appropriate form. In addition, in order to enable pre-literate children to play, the containers 38 and 40 may be color coded or otherwise marked in some manner in order to enable persons unable to read to successfully play the game.

In order to prepare the game for play, blocks 14 are first placed within their corresponding spaces 12 within game board 10, positioned so that the tops of the alphanumeric characters 24 on each block 14 are oriented toward the upper row 18 of the board 10. All tiles 32 are placed in the "new" container 38.

As the play of the game evolves (as will be more fully described below), the tiles 32 will be drawn from the "new" container 38 in accordance with the rules of the game and placed in container 40 for "used" tiles 32 after their use and will not be used again during the play of that particular game.

Two or more players may play. The order of play is determined by each player drawing a tile 32 from the "new" container 38 and comparing the alphanumeric characters 24 marked upon their tile 32. The player drawing the tile 32 marked with the lowest letter, i.e., the letter closest to the beginning of the alphabet, will play first. If no tiles 32 with letters are drawn, then the player drawing the tile 32 marked with the lowest number will play first. Players will be generally arranged around the board 10, and play will proceed from the first player to the adjacent player around the board 10. After determining the order pf play, the tiles 32 drawn are returned to the "new" container 38 to be used in the course of play of the game. For those players who may have difficulty in determining the order of play by such a method, alternative methods may be used or the order of play may be determined by a supervisory person as required. One such method may be the matching of the colors of the playing tiles 32, with the first player determined by the drawing of a tile 32 matching the color of a given row of the playing board 10 or the color of a specific tile 32 drawn for this purpose.

The game is started when the first player selects a tile 32 from the "new" container 38 and attempts to match the alphanumeric character 24 on that tile 32 with the corresponding block 14 located within a space 12 of board 10. During this first play of the game it is understood that a match will always be possible, as all blocks 14 will be installed within spaces 18 of the board. Upon making a proper match, that player removes the corresponding block 14 from its space 12 on board 10 and places it in front of him or her. If an incorrect match is made, the block 14 chosen would remain on the board 10. However, such an incorrect match may be precluded in a learning environment by a supervisor aiding the players of the game. In any case the tile 32 drawn to make the match is then placed into the "used" tile container 40 and play then proceeds to the next player, who plays in a like manner.

As play proceeds, more blocks 14 will be removed from the board 10 and stacked in front of each player according to that player's correct matches. This will leave more and more of the spaces 12 on board 10 empty, thus precluding a correct match for any player who happens to draw a tile 32 corresponding to an empty space. In such a case, no block 14 may be removed from the board 10 and, after the tile 32 drawn from the "new" tile container 38 is placed in the "used" tile container 40, play continues with the next player. Eventually all blocks 14 will be removed from their corresponding spaces 12 on board 10 and will be stacked in front of the various players who made correct matches and thus removed those blocks 14 from the board 10. The winner of this version of the game is the player with the highest stack of blocks 14 in front of him or her; in other words, the player who made the most correct matches in the course of the game. By comparing the height of the stacks of blocks 14 collected by the various players, the winner may be determined by inspection rather than requiring knowledge of arithmetic, counting or other scoring systems.

Another variation of the above game allows for the "capture" of blocks 14 already removed from board 10 by another player or players. In this version, a player who is unable to make a correct match due to the corresponding block 14 having already been removed from board 10 by another player, is allowed to take or capture that corresponding block 14 from the stack or collection of the other player. The remaining rules are the same; the player with the highest stack of blocks 14 when all blocks 14 have been removed from the board 10 is the winner. The fact that all blocks 14 are marked with their appropriate alphanumeric character 24 on their vertical faces 20 as well as their upper faces 22 permits the correct blocks to be distinguished from others, even though the upper faces 22 of all blocks 14 other than the topmost one will be hidden by the blocks 14 above.

Yet another variation is played by placing all game tiles 32 face down rather than placing them into a container 38. When the tiles 32 are placed face down, the face 34 which is marked with the alphanumeric character 24 will be hidden. Thus, there will be nine different colors of tiles 32 displayed, corresponding to the nine colors of the horizontal rows 18 of board 10 and the nine corresponding colors of the blocks 14. In this version, a player has some additional control over the outcome of the game since he or she may choose a tile 32 having a given color. A player will have a greater chance of success on any given play by choosing a tile 32 having a color corresponding to the color of a row 18 which contains more of the blocks 14 than other rows 18 of the board 10, as the game progresses. The winner is determined as described above. This version may be played according to the rules described above for either the standard version of the game, or according to the "capture" version.

Still other versions may be played in which the first player to collect all of the blocks 14 from any horizontal row 18, thus all of the blocks 14 of one color, is the winner. Alternatively, the goal of the game may be to collect one block 14 of each color, the first player to collect nine blocks 14 comprising all of the colors used in the game being the winner. Once again, either the standard or "capture" rules may be used. If the object is to collect blocks 14 having each of the colors of the game, the rules may be further restricted to require that the blocks 14 containing the various colors be from a single vertical column 16.

In each of the above variations, particularly those involving the capture or taking of blocks 14 already removed by other players, the game may progress for a greater period of time than desirable. This may be particularly true in a classroom or other formal group situation where time is limited. If such is the case, a time limit may be placed on the play of the game with the player having the highest stack of blocks 14 at the end of the allotted time period being declared the winner.

While the basic game described above may not provide continued interest for more mature players, many of the variations described serve to make the game more interesting to those more mature players. To further increase the difficulty, the blocks 14 may be initially installed in random directions within the spaces 12 of board 10 prior to beginning the game, i. e., with the tops of the alphanumeric characters 24 facing toward the top, bottom or either side of the board. Such a placement of the blocks 14 within the spaces 12 of the board 10 will serve to increase the difficulty of reading the alphanumeric characters 24 on the upper faces 22 of each block 14. Alternatively, more advanced players may be positioned near the top of the board in order that they will be required to read the alphanumeric characters 24 of the blocks 14 upside down when those blocks 14 are each placed upright within spaces 12 of board 10 prior to beginning the game. Thus, a game is provided which in some versions allows even pre-literate or illiterate individuals to play with as great a chance of winning as literate players, and which encourages and helps to develop the learning of the English alphabet and basic numbering system during the course of play of the game. At the same time, additional challenges may be added to hold the interest of more advanced players.

It is to be understood that the present invention is not limited to the sole embodiment described above, but encompasses any and all embodiments within the scope of the following claims.

I claim:

1. A board game involving the matching of randomly drawn playing tiles with corresponding playing blocks, said board game including a playing board, said playing board divided into spaces providing for the separate containment of a corresponding number of said playing blocks, said spaces of said playing board, said playing blocks and each of one or more sets of said playing tiles corresponding to and marked with the set of characters comprising the twenty six letters of the English alphabet and the numbers one through ten inclusive, and separate containers for the placement and storage of said playing tiles.

2. The board game of claim 1 wherein;

said game board contains a matrix of said spaces comprising four vertical columns by nine horizontal rows.

3. The game board of claim 2 wherein;

said horizontal rows are each of a different color, said different colors generally including the colors associated with the visible spectrum of light and arranged according to relative wavelength, and said playing blocks and said playing tiles marked with said characters corresponding to said characters of said playing board spaces also colored corresponding to said colors of said spaces of said horizontal rows.

4. A method of playing a board game involving the matching of randomly drawn playing tiles with corresponding playing blocks placed on a game board, said game board divided into spaces providing for the separate containment of a corresponding number of said playing blocks, said spaces of said playing board, said playing blocks and each of one or more sets of said playing tiles corresponding to and marked with the set of characters comprising the twenty six letters of the English alphabet and the numbers one through ten inclusive, the method including the following steps;

Installing said playing blocks within the corresponding spaces of said game board, arranging any players generally around said game board, choosing a first player, said first player randomly drawing one of said playing tiles, matching said marking of said playing tile with said marking of one of said playing blocks, removing said playing block which has been matched from said playing board and placing said matched playing block near said first player, placing said playing tile in a storage container, proceeding to the next player and continuing play in a like manner with said next player and any subsequent players until all of said playing blocks have been removed from said playing board and stacked near each player making matching plays, and determining the winner of said board game by determining the highest stack of said playing blocks.

5. The method of play of claim 4 wherein;

determining said winner by said player having said highest stack of said playing blocks at the end of a predetermined period of time.

6. The method of play of claim 4 including;

matching the marking of said playing tile with the marking of one of said playing blocks, removing said playing block which has been matched from said playing board and placing said matched playing block near said first player, or removing said playing block which has been matched from one of said stack of said playing blocks near one of said players.

7. The method of play of claim 6 including;

determining said winner by said player having said highest stack of said playing blocks at the end of a predetermined period of time.

8. A method of playing a board game involving the matching of randomly drawn playing tiles with corresponding playing blocks placed on a game board, said game board divided into spaces providing for the separate containment of a corresponding number of said playing blocks, said spaces of said playing board, said playing blocks and each of one or more sets of said playing tiles corresponding to and marked with the set of characters comprising the twenty six letters of the English alphabet and the numbers one through ten inclusive, said game board containing a matrix of said spaces comprising four vertical columns by nine horizontal rows, each of said horizontal rows having a different color, said different colors generally including the colors associated with the visible spectrum of light and arranged according to relative wavelength, said playing blocks and said playing tiles having colors corresponding to said different colors of said spaces, the method including the following steps;

Installing said playing blocks within the corresponding spaces of said game board, arranging any players generally around said game board, choosing a first player, laying out said playing tiles in a manner that said playing tile markings are concealed, said first player drawing one of said playing tiles according to said playing tile color, exposing said playing tile marking, matching said playing tile marking with said playing block markings, removing said playing block which has been matched from said playing board and placing said matched playing block near said first player, placing said playing tile in a storage container, proceeding to the next player and continuing play in a like manner with said next player and any subsequent players until all of said playing blocks have been removed from said playing board and stacked near each player making matching plays, and determining the winner of said board game by determining the highest stack of said playing blocks.

9. The method of play of claim 8 including;

determining said winner by said player having said highest stack of said playing blocks at the end of a predetermined period of time.

10. The method of play of claim 8 including;

matching said playing tile marking with said playing block markings, removing said playing block which has been matched from said playing board and placing said matched playing block near said first player, or removing said playing block which has been matched from one of said stack of said playing blocks near one of said players.

11. The method of play of claim 10 including;

determining said winner by said player having said highest stack of said playing blocks at the end of a predetermined period of time.

12. The method of play of claim 10 including;

determining said winner by said player first collecting all of said blocks of a single row.

13. The method of play of claim 12 including;

determining said winner by said player having said highest stack of said playing blocks at the end of a predetermined period of time.

14. The method of play of claim 10 including;

determining said winner by said player first collecting all of said blocks of a single column.

15. The method of play of claim 14 including;

determining said winner by said player having said highest stack of said playing blocks at the end of a predetermined period of time.

16. The method of play of claim 8 including;

determining said winner by said player first collecting all of said blocks of a single row.

17. The method of play of claim 16 including;

determining said winner by said player having said highest stack of said playing blocks at the end of a predetermined period of time.

18. The method of play of claim 8 including;

determining said winner by said player first collecting all of said blocks of a single column.

19. The method of play of claim 18 including;

determining said winner by said player having said highest stack of said playing blocks at the end of a predetermined period of time.

* * * * *